United States Patent [19]

Ramon, Jr.

[11] Patent Number: 5,074,554

[45] Date of Patent: Dec. 24, 1991

[54] GAME APPARATUS UTILIZING A STRIKING MEMBER HAVING DUAL HAND GRIPS AND TRIPLE PADDLES

[76] Inventor: Armando Ramon, Jr., 10770 Village Rd., Moreno Valley, Calif. 92387

[21] Appl. No.: 623,093

[22] Filed: Dec. 6, 1990

Related U.S. Application Data

[63] Continuation-in-part of Ser. No. 2,633, Aug. 3, 1987, abandoned.

[51] Int. Cl.[5] ..... A63B 59/00

[52] U.S. Cl. ..... 273/67 R; 273/73 C; 273/73 R

[58] Field of Search ..... 273/67 R, 67 D, 67 DA, 273/67 DB, 67 DC, 73 R, 76, 73 C; 272/76

[56] References Cited

U.S. PATENT DOCUMENTS

| | | | |
|---|---|---|---|
| 3,606,322 | 9/1971 | Kersch | 273/67 R |
| 3,674,266 | 7/1972 | Grosberg | 273/67 R |
| 4,221,383 | 9/1980 | Cappelli | 273/73 C |
| 4,570,932 | 2/1986 | Cote | 273/67 A |

FOREIGN PATENT DOCUMENTS

| | | | |
|---|---|---|---|
| 7829 | of 1902 | United Kingdom | 273/76 |
| 381673 | 11/1932 | United Kingdom | 273/73 C |

*Primary Examiner*—Benjamin Layno

*Attorney, Agent, or Firm*—Chris Papageorge

[57] ABSTRACT

A game apparatus used for striking a game ball has a striking member having dual hand grips so that both hands may be used to wield the apparatus. Impact members are provided at both ends and at the center of the striking member to enable the user to select the impact members deemed most effective to use to strike the ball. In one embodiment, there is a first impact surface on the outer impact members which is flat and stepped inwardly and a second impact surface at the opposite faces of the impact members which is simply flat enabling the user to strike the ball with the impact surface which imparts the desired rebound characteristics to the ball by simply turning the striking member over. In a second embodiment, the impact surfaces are all flat. In a third embodiment, the first surface is curved while the opposite second impact surface is flat. In one embodiment, the game apparatus is of unitary construction, while in the other embodiments the outer impact members are detachably secured to the center impact and the outer impact members are interchangeable with each other.

24 Claims, 3 Drawing Sheets

GAME APPARATUS UTILIZING A STRIKING MEMBER HAVING DUAL HAND GRIPS AND TRIPLE PADDLES

This application is a continuation-in-part of application Ser. No. 002,633 filed Aug. 3, 1987, now abandoned.

BACKGROUND OF THE INVENTION

The invention relates generally to sporting games and particularly to a game apparatus which allows the player to use both hands in addition to exercising more of the upper body in playing generally conventional games such as tennis and ping pong thereby providing a more total body workout than conventional game apparatuses.

Popular games such as ping pong are commonly played with game apparatuses which utilize a single impact member such as a conventional tennis racket or ping pong paddle. Consequently, the players are able to utilize only a single hand and those parts of the body which are used to bring that hand into motion to play the game. As a result, only a relatively small part of the body is well exercised when the player uses such conventional game apparatuses in playing these types of games. In particular, the left hand, left arm and left part of the torse of the (right handed) player are not typically given a good workout while the right hand, right arm and right part of the torso of the (right handed) player are typically given a relatively strong workout. However, in order to achieve a well developed physique, it is more desirable that both hands, arms and both sides of the torso must be exercised to approximately the same degree. It is also more desirable that the player develop both hands, arms and both sides of the torso in order to develop a totally fit body which has strength, coordination and endurance capabilities which are generally well balanced body so that the full physical capabilities of the player are enhanced. In addition, those who play these games with such conventional, prior art apparatuses find that utilizing only one hand and arm sometime places these body parts (and other body parts associated therewith) in awkward and uncomfortable positions during play thereby detracting from enjoyment of the game. Moreover, many players whose use such prior art game apparatuses find that repetitive use of only one hand and arm in such games results in overstressing of some body parts producing such chronic maladies as "tennis elbow". Consequently, many game players using prior art game apparatuses find themselves discontent with their efforts to exercise recreationally and often feel they are doing themselves more harm than good in playing these games despite their dedicated and persistent game playing efforts which might have arisen solely from the self improvement goals they have set for themselves. Many players thus become discouraged from playing these and other sporting games as well. Moreover, many such players also may become discouraged from exercising in any form whatsoever. However, other players who develop chronic physical maladies from the game nevertheless continue to play. Such players who continue to tolerate the pain and physical restrictions resulting from the maladies often may adopt the rationale that the maladies are the price to be paid for achieving the desired physical conditioning and/or physical prowess in the sport. Another important shortcoming of prior art game apparatuses utilizing a single racket or paddle is that they require the user to cover a relatively large area of the tennis court or other playing area with the single impact surface of such a prior art racket or paddle so that the player frequently must twist or stretch his back or certain other parts of the body to an excessive degree in order to extend his reach sufficiently to strike the ball. Such twisting and stretching movements can contort and overstress the player's spine, joints and other parts of the body resulting in injury thereto. Consequently, many people are discouraged from playing such sporting games even though they would attain a better level of physical fitness and improve their general sense of well being by regularly obtaining the exercise and recreational enjoyment such games can provide.

Recognizing these shortcomings, many sporting games have been introduced which are intended to subject the player's body to less strain. However, such games have not been entirely successful in displacing such popular recreational sporting games as tennis and ping pong. Some of these games have utilized game balls which have holes therein or aerodynamic appendages attached thereto in order to slow the ball down and thereby give the receiving player more time to react and properly position himself for returning the ball. Such game apparatuses may indeed place less stresses and strains on certain important body parts and be less likely to put the user in awkward and uncomfortable positions. Nevertheless, however, many players have not found such games as exciting or as interesting as the conventional games they were designed to replace, and such games have therefore not enjoyed widespread popularity.

Some prior art game apparatuses designed for tennis or ping pong type games are designed to obviate the awkward strike positions inherent in the competitive use of conventional tennis and ping pong game apparatuses. An example of such a prior art apparatus is disclosed in U.S. Pat. No. 3,674,266 to Grosberg. The Grosberg apparatus is essentially a double ended paddle which allows the paddle to be grasped with both hands. The impact surfaces at the ends of the paddle in conjunction with the long handle which can accomodate both of the user's hands obviates the necessity of using a backhand stroke when returning the game ball. However, a major disadvantage with this apparatus is that the handle has a square cross-sectional shape which makes it uncomfortable for the player to use. In addition, if a ball is directed straight to a player, the player who is using such an apparatus must move laterally in order to position himself astride the oncoming ball so that he can strike it effectively. Thus, this type of prior art apparatus does not always allow the user to effectively return the ball and in some instances is somewhat awkward to use. For these same reasons, it also does not facilitate effective and efficient game playing. In addition, the relatively thin paddles and shank portions make the apparatus too weak to hold up under the relatively impact forces of tennis.

Other prior art game apparatuses provide more playing capabilities to the user by including multiple impact members. An example of such a prior art apparatus is disclosed in U.S. Pat. No. 3,606,322 to Kersch. The Kersch apparatus is a striking paddle having three or more impact members and two or more handles interdisposed therebetween. The Kersch paddle is specifically designed to strike a free swinging ball. Consequently, an important disadvantage of such an apparatus is that its special purpose structure does not allow it to be effectively used to play other games such as tennis which do not utilize a ball connected to a string. In addition, the Kersch impact members are all the same dimensional size which makes the apparatus more awkward to use because the outer impact members which require that the ball be struck in a swinging motion require a different dimensional size than the center impact member which requires that the ball be struck in a bunting type motion. Thus, if the outer impact members are the optimum dimensional size then the center impact member is too large and vice versa. Moreover, this dimensional size of the impact members also dictates, to a certain degree, the spacing of the handles. Consequently, the handles may be spaced too far apart or too closely apart in relation to the dimensional size of the impact members for effective use of the striking apparatus, and such an apparatus may thus feel awkward at times. Therefore, this type of prior art apparatus does not provide a striking apparatus which the user can utilize to effectively put into play all his desired game playing skills. In addition, as with the Grosberg apparatus, the Kersch apparatus does not have sufficient structural strength to hold up under the relatively high impact forces of sporting games such as tennis.

A sporting game playing apparatus is thus needed that can provide the user with a striking member which is comfortable to use, gives the user a more total body workout and minimizes risk of personal injury by both placing less strain on certain body parts and by facilitating smoother, more orthopedically correct body movements.

It is a principal object of the present invention to provide a game playing apparatus that provides the user with a generally total upper body workout.

It is another object of the present invention to provide a game playing apparatus that provides reduced risk of overstrain and overstress on certain joints, muscles and certain other body parts thereby reducing risk of injury thereto.

It is another object of the present invention to provide a game playing apparatus having a striking member with multiple impact members which are positioned and dimensioned to allow the user to more effectively utilize and develop his game playing skills.

It is another object of the present invention to provide a game playing apparatus which allows the user to selectively use striking member impact surfaces which yield either fast or slow moving game balls.

It is another object of the present invention to provide a game playing apparatus having impact members which are detachable and interchangeable so that the game apparatus can accommodate game playing areas of different dimensional sizes.

It is also another object of the present invention to provide a game playing apparatus having a striking member with impact surfaces which are angled inward to accommodate the dimensional size of the game playing area.

It is still another object of the present invention to provide a game playing apparatus having a striking member with impact surfaces which have a radius of curvature selected to accommodate the dimensional size of the game ball.

The game apparatus of the present invention is specifically designed to allow the user to grasp the striking member with both hands and to strike the ball with either of multiple impact members one of which is positioned at the center and the others of which are at both ends of the striking member. Thus, the user uses both hands, both arms and the muscles of the upper torso associated therewith to strike the ball. Since generally the entire upper body of the user comes into play when using the apparatus of the present invention, the user exercises, trains and develops the entire upper body rather than only one hand, arm and the muscles of the upper body associated therewith. Thus, since the apparatus of the present invention exercises more of the user's body than conventional prior art apparatuses which have only a single impact member, the apparatus of the present invention provides more well balanced exercise and training resulting in more well balanced development of both arms, hands and upper body of the user. Consequently, the user of the game apparatus of the present invention is better able to develop improved strength, flexibility and coordination of the entire upper body than a user of prior art game apparatuses.

Two of the impact members are positioned at both outer ends of the shaft portions of the striking member so that the user can return game balls that are directed to either lateral side of him. This feature of the game apparatus of the present invention enables the user to strike balls at either lateral side without overtwisting or overstretching hands, arms or torso thereby minimizing undue stresses and strains on these body parts. In addition, another impact member positioned generally at the central portion of the striking member allows the user to easily and effectively strike balls that are directed straight at him. In contrast, more conventional prior art apparatuses require the user to move laterally in order to get into a proper position to effectively strike the ball. As with oncoming game balls which are laterally a substantial distance from the player requiring overtwisting or overstretching the player's body to get the desired reach (or proper swing) using a single impact member, game balls directly in front of the player also may require overtwisting or overstretching the player's body in order to quickly get into the position required to effectively strike the ball with such prior art apparatuses. Consequently, the game apparatus of the present invention provides reduced risk of injury to these body parts when compared to prior art apparatuses which have only one or two impact members. In addition, since the apparatus of the present invention generally eliminates the necessity of the backhand stroke which is typically awkward and difficult to learn, the apparatus of the present invention is easily adaptable as a physical education training aid to those generally unskilled in conventional sporting games such as tennis.

The impact members and the striking member preferably have interconnecting structures which preferably include a winged shaft portion of the impact members which fit into a slotted recess in the striking member. These interconnecting structures prevent rotation of the impact members relative to the striking member when the impact members are subjected to high impact forces during use. These unique structures enable the user to put a lot of power behind the stroke without damaging the apparatus and without causing undesired rotational movement of the apparatus which could otherwise alter the directional movement of the rebounding ball.

The impact members also are preferably detachable from the striking member. This detachability feature allows the user to connect different impact members to the striking member in order to tailor the game apparatus to the dimensional size of the game playing area and/or the particular game playing structures with which the apparatus is to be used. For example, relatively long and/or large impact members may be connected to the striking member in order to provide a longer reach and wider swing, as appropriate for a tennis court, and, conversely, relatively short and/or small impact members may be connected to the striking member in order to provide a narrower, more compact apparatus which is relatively more maneuverable, as appropriate for a ping pong table. Also, this detachability feature allows the user to select the impact members which have the desired type of impact surface for the particular game or for the desired degree of workout intensity. In addition, this feature allows the selection of impact members which are dimensioned to accomodate the dimensional size of the game ball. Since multiple impact members may be interchangeably connected to the striking member, the game apparatus of the present invention may be used to play various different games in game playing areas of different dimensional sizes with a minimum number of component parts for improved versatility, compactness and portability.

Another embodiment of the game apparatus of the present invention includes a stepped (but otherwise generally flat) impact surface on each of the outer impact members. The stepped impact surface generally tends to deaden the ball on rebound reducing its speed in flight while the opposite (unstepped) impact surface provides the ball on rebound with generally normal speed in flight, for the same striking force. The different impact surfaces positioned on opposite sides of the impact members allow the user to easily choose how he wants the ball to move when struck by simply turning the striking member so that the desired impact surfaces are facing outwardly. This important feature of the present invention provides the user with more control over movement of the ball thereby enhancing the user's game playing capabilities. In addition, this important feature enables the user to select the impact surfaces which allows him to work harder or easier, as desired, in serving and returning the ball. Concomitantly, this feature also enables the user to choose (to a certain extent) the degree of intensity of the workout and also to vary the intensity of the workout at will during the game thereby enabling the user to have more personal control over the training, exercise and physical development which are provided by playing the game.

DETAILED DESCRIPTION OF THE PREFERRED EMBODIMENTS

Figure 1:
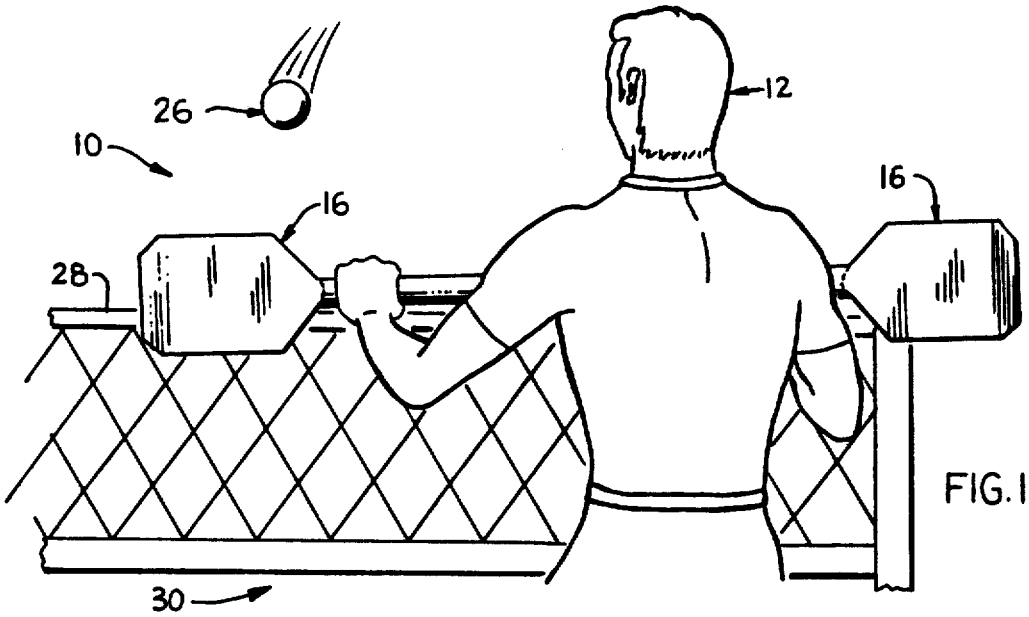
FIG. 1 is a perspective view showing a game player using the invention on a tennis court.
Figure 2:
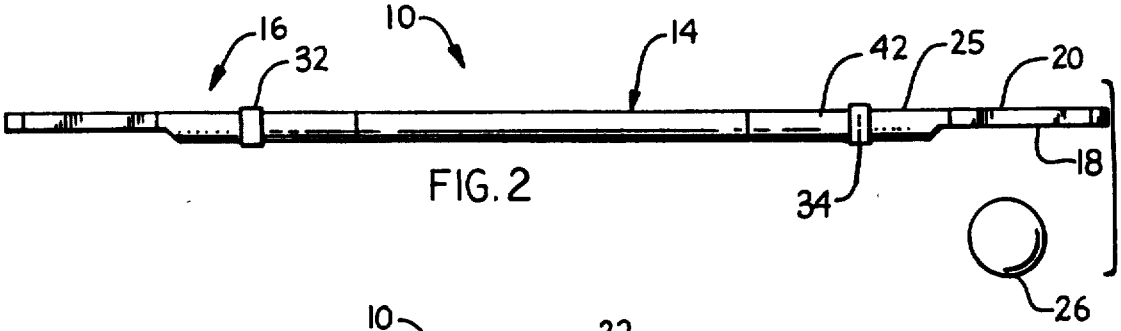
FIG. 2 is an top elevational view of a first embodiment of the invention illustrating the stepped impact surfaces of the impact members and the size of the ball relative thereto.

Referring to the drawings, FIG. 1 shows a first embodiment of the game apparatus of the present invention generally designated by the numeral 10. Game apparatus 10 is shown held by a game player 12 as he is preparing to use it to strike an oncoming game ball 26. FIG. 1 shows the game apparatus 10 in use in a game playing area 30 depicted as a tennis court, although other types of game playing areas may also be suitable. FIG. 1 also shows the game apparatus 10 being used in conjunction with a game net 28 depicted as the type used in tennis, although use of a net is not necessary and other suitable game structures may also be used. Game apparatus 10 preferably has a striking member 14, outer impact members 16 and center impact member 16, as shown in FIG. 2. Outer impact members 16 have a first impact surface 18 and a second impact surface 20 for making contact with the game ball 26. The first impact surface 18 is preferably stepped inwardly from the body 19 of the impact member 16. Impact surface 18 is preferably (singly) stepped so that it has a single generally flat surface which is spaced from the body 19 of the impact member 16 toward the lengthwise centerline of the impact member 16 (and the lengthwise centerline of the striking member 14 when impact member 16 is secured thereto). This inwardly stepped structure of surface 18 tends to slow down ball 26 when struck with the surface 18. The stepped surface 18 also tends to provide a spin to the ball 26 which it impacts. This feature gives the user more control over movement of the game ball than he would otherwise have. The second impact surface 20 is preferably generally flat providing the rebounding ball 26 with generally the same speed it had prior to impact. In addition, impact surface 20 does not tend to provide a spin to the ball 26 but instead propels the ball 26 in a trajectory (or direction) which is more generally straight than impact surface 18 propells the ball 26. Thus, the second impact surface 20 imparts more typically unremarkable movement characteristics to the game ball than surface 18.

The impact surfaces 18 and 20 are preferably substantially larger in length and preferably a little larger in width (or alternatively approximately the same size in width) than the diameter of the game ball 26 (which may, for example, be approximately 3 inches to 5 inches in diameter) with which game apparatus 10 is to be used. As illustrated in FIG. 2, the impact surfaces 18 and 20 are preferably approximately 50% longer than the diameter of the ball 26.

Figure 3:
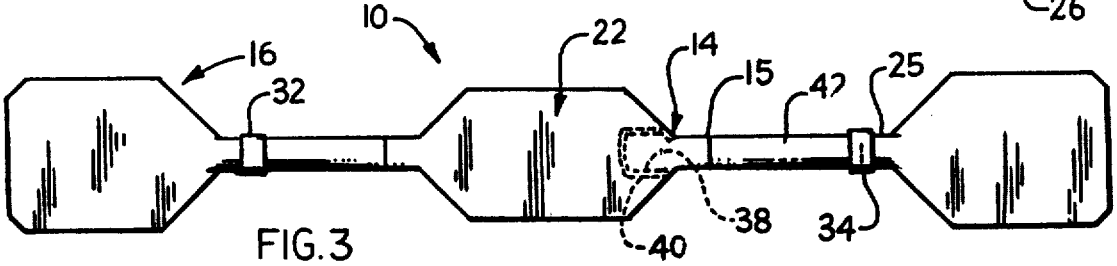
FIG. 3 is a front elevational view of the first embodiment of the invention.

The shape of the impact members 16 and impact surfaces 18 (the shape of impact surfaces 20 are essentially identical) are illustrated in FIG. 3. The impact members 16 generally have a preferably generally cylindrical shaft portion 25 with a preferably generally rectangularly shaped impact surface 18 (generally tapered where it meets the shaft portion 25) at the outer ends thereof, as shown in FIG. 3. It is deemed that this shape is preferable for relatively large game playing areas 30 such as a tennis court. However, other shapes may also be suitable.

Game apparatus 10 also includes a striking member 14 which includes a generally elongate shaft portion 15 (preferably cylindrical) with a center impact member 22 at the central or medial portion of striking member 14. Center impact member 22 is preferably integral with striking member 14 although impact member 22 may alternatively also be rigidly secured to striking member 14. The center impact member 22 is preferably smaller in length and width than the outer impact members 16 the center impact member 22. Because the center member 22 is closer to the centerline of the player's body than the outer members 16, it is often easier to strike a ball directly in front of the player 12 with the center member 22; therefore, the smaller impact area of the center impact member 22 is sufficiently large for it to be effective to propel the ball with a bunting motion. The smaller dimensions of center member 22 also allow the outer impact members 16 both to be larger to make it easier to hit the ball 26 and to be spaced closer together to enhance deft handling of the game apparatus 10. The preferred generally rectangular shape (generally tapered where it meets the shaft portion 15) of the center impact member 22 is shown in FIG. 3, although other shapes may also be suitable.

Striking member 14 preferably is provided with hand grips 42 at its outer portions of the shaft portions 15, as shown in FIGS. 2 and 3. Hand grips 42 may have other surfaces composed of leather or rubber (or simply a roughened surface) to provide a more effective gripping surface.

Figure 4:
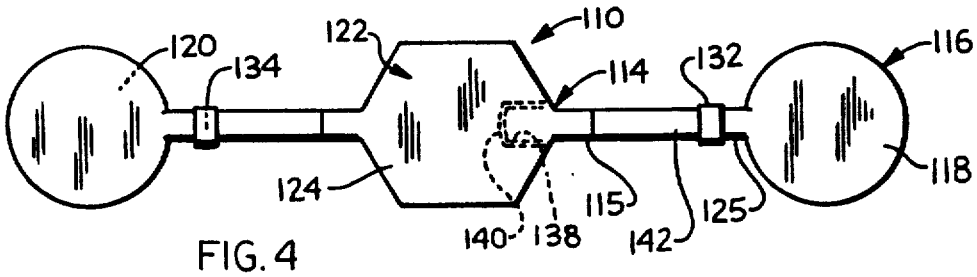
FIG. 4 is a front elevational view of a second embodiment of the invention generally similar to the first embodiment except that it is dimensioned to accommodate a relatively small game playing area.

The second embodiment 110 of the invention is shown in FIG. 4. The second embodiment 110 is essentially simply a smaller version of the first embodiment 10. Game apparatus 110 is scaled down to accommodate a smaller game playing are such as a ping pong table. Game apparatus 110 has a striking member 114, outer impact members 116, center impact member 22, shaft portions 15 and 25 and hand grips 142, as with embodiment 10. However, the outer impact members 116 have impact surfaces 118 and 120 which have a generally circular shape. The hand grips 142 are spaced closer together and the overall length of the apparatus 110 is narrower than apparatus 10 to provide more deft handling in the relatively close quarters of the ping pong playing area. In addition, the impact surfaces 124 of the center member 22 and the impact surfaces 118 and 120 are smaller in length and width than surfaces 24, 18 and 20 of embodiment 10 in order to accomodate the smaller game ball 126 used in games such as ping pong.

Figure 5A:
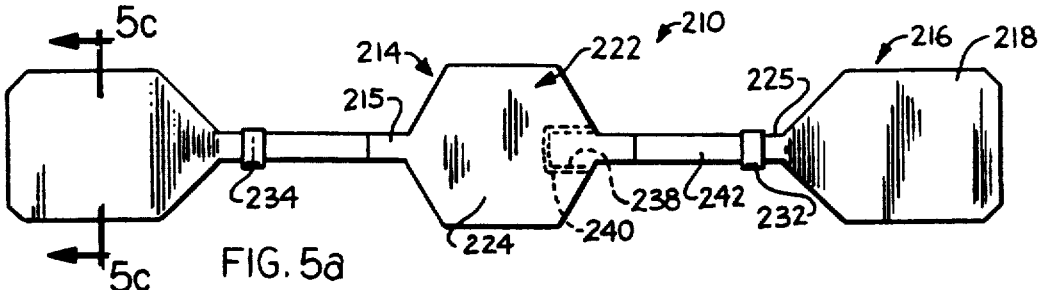
FIG. 5*a* is a front elevational view of a third embodiment of the invention.
Figure 5B:
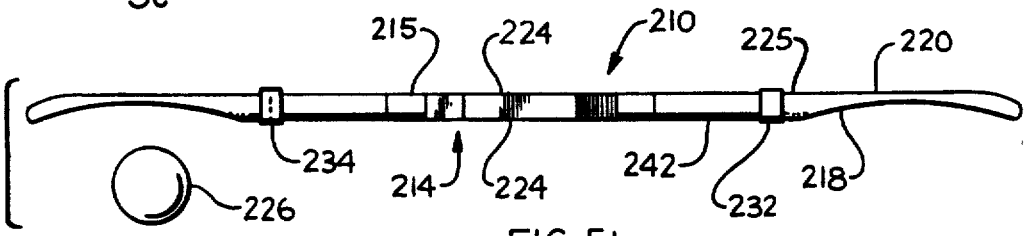
FIG. 5*b* is a top elevational view of the third embodiment of FIG. 5*a* showing the horizontal curvature of the impact members.
Figure 5C:
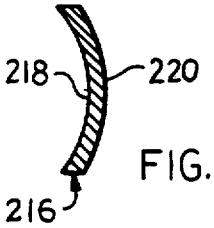
FIG. 5*c* is a cross-sectional view of the third embodiment of FIGS. 5*a* and 5*b* taken along lines 5*c*—5*c* of FIG. 5*a* showing the vertical curvature of the impact members.

The third embodiment 210 of the invention has a striking member 214, outer impact members 216, center impact member 222, shaft portions 215 and 225 and hand grips 242, as shown in FIG. 5*a*. Impact surfaces 218, 220 and 224 are also generally rectangular in shape (and tapered where they meet the shafts 215 and 225), as with embodiment 10. However, first impact surfaces 218 are preferably generally concave. The horizontal curvature is shown in FIG. 5*b* and the vertical component of the curvature is shown in FIG. 5*c*. This generally curves surface has a radius of curvature which is approximately the same as (or not much larger than) the diameter of the game ball 226 so that the first impact surface 218 generally accomodates the dimensions of the ball 226. Thus, the direction in which the ball 226 is propelled upon impact with surface 218 depends upon the point on the surface 218 on which the ball 226 impacts. In addition, the centerpoint of the curvature radius is positioned generally inwardly toward the center of the apparatus 210 so that the impact surfaces 218 are generally curved inwardly. The other impact surfaces 220 and 224 are generally flat, as with embodiments 10 and 110. In all other respects, embodiment 210 is essentially identical to embodiment 10.

Figure 6A:
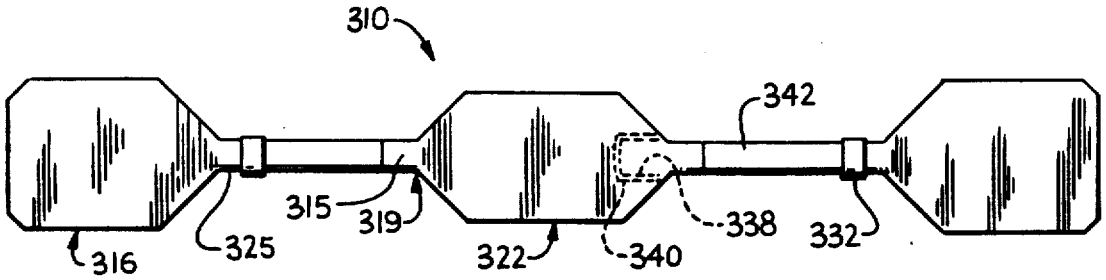
FIG. 6*a* is a front elevational view of a fourth embodiment of the invention.
Figure 6B:
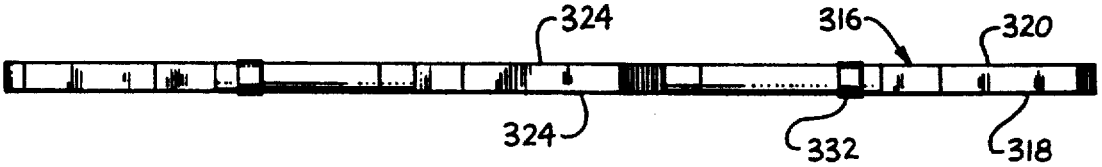
FIG. 6*b* is a top elevational view the fourth embodiment of FIG. 6*a* showing the generally flat impact surfaces.

The fourth embodiment 310 has a striking member 314, outer impact members 316, center impact member 322, shaft portions 315 and 325 and hand grips 342, as shown in FIG. 6. However, impact surfaces 318 and 320 of outer impact members 316 and impact surfaces 324 of center impact member 322 are generally flat rather curved or stepped. In addition, the impact surfaces 318, 320 and 324 have a generally rectangular shape (and are generally tapered where they meet shafts 315 and 325), as shown in FIG. 6, although other shapes may also be suitable.

Figure 7:
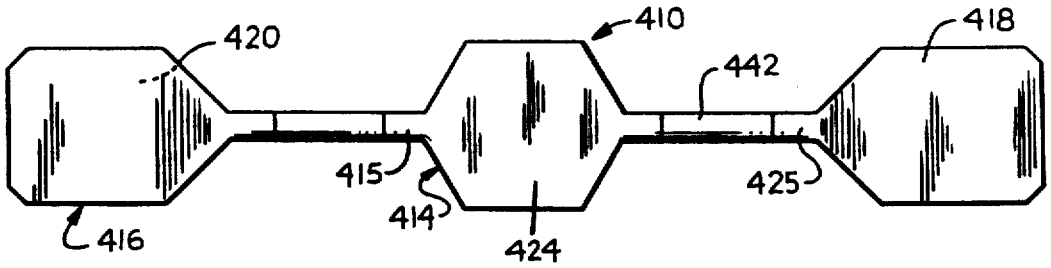
FIG. 7 is a front elevational view of a fifth embodiment of the invention which is of generally unitary construction.

Fifth embodiment 410 has a striking member 414, outer impact members 416, center impact member 424, shaft portions 415 and 425 and hand grips 442, as shown in FIG. 7. In addition, impact surfaces 418, 420 and 424 are generally flat, as with the corresponding surfaces 318, 320 and 324 of embodiment 310. However, embodiment 410 is of preferably unitary construction. Thus, other impact members 416 are integral with striking member 414, rather than separate components which are attached together, as with embodiments 10, 110, 210 and 310. Since it is of unitary construction, the game apparatus 410 is relatively inexpensive to manufacture and provide sufficient structural strength for many game playing applications. In all other respects, embodiment 410 is identical to embodiments 10, 110, 210 and 310.

Figure 8A:
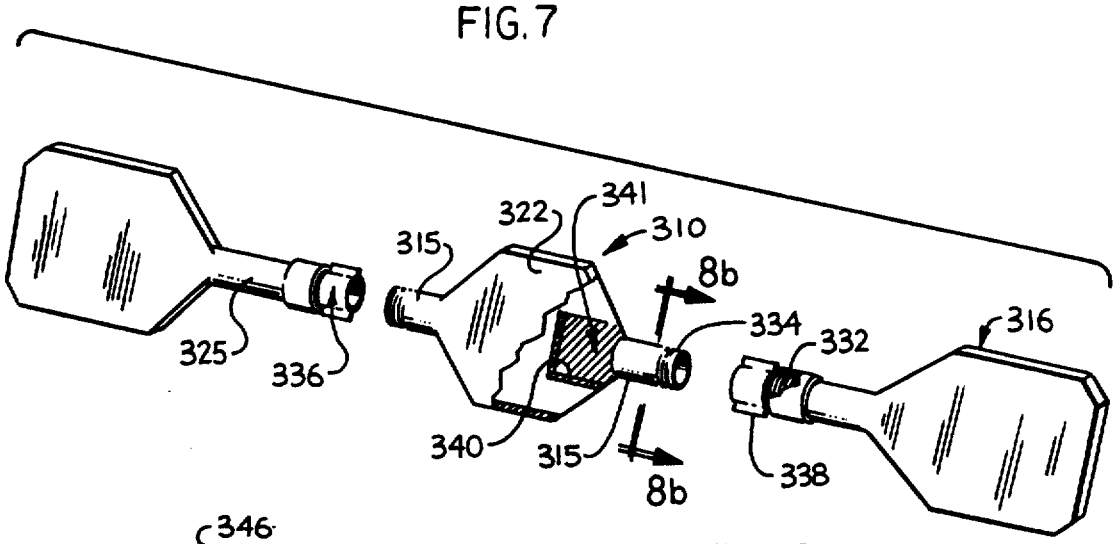
FIG. 8*a* is an exploded perspective view of the fourth embodiment of FIG. 6, also representative of the first, second and third embodiments, illustrating the interconnecting structures and attaching structures thereof in detail.
Figure 8B:
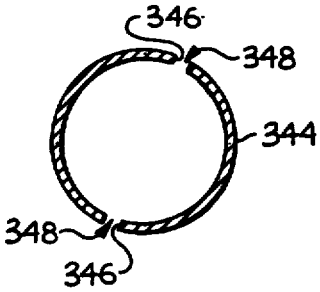
FIG. 8*b* is a cross-sectional view of one of the attaching structures of the fourth embodiment of FIG. 8*a*, also representative of the first, second and third embodiments.

FIGS. 8*a* and 8*b* show the attaching means and interconnecting means for connection and attachment of the outer impact members 316 to the striking members 314 in detail. The outer impact members 316 have a threaded female attaching structure at generally the shaft portion 325 thereof, as shown in FIG. 8*a*. The striking member 314 has threaded male attaching structures 334 at shaft portions 315 thereof which mate with structures 332 and thereby enable attachment of outer structures 316 to striking member 314. Female attaching structure 332 is preferably essentially a collar structure 332 which snugly fits around shaft portion 325 and is free to rotate relative thereto and free to slide along the length of the shaft 325, as shown in FIG. 8*a*. However, other suitable attaching structures may also be used. Although described in detail only for embodiment 310, the attaching structures 232 and 234 of embodiment 210, the attaching structures 132 and 134 of embodiment 110 and the attaching structures 32 and 34 of embodiment 10 are essentially identical in structure and function to structures 332 and 334 so their description will not be repeated for the sake of brevity.

The outer members 316 also have male interconnecting structures 336 which have winged portions 338 at their outer surfaces which preferably extend in a generally radial direction from the shaft portion 325, as shown in FIG. 8*a*. The center member 322 has female interconnecting structures 340 which define a recess 341 in the center impact member 322, as shown in the cut away portion of FIG. 8*a*. The recess 341 and the winged portions 338 are dimensioned so that male interconnecting structure 336 and its winged portions 338 fit securely within recess 341 thereby generally preventing rotational movement of outer impact members 316 relative to striking member 314. Striking member 314 includes outer cylindrical portions 344 which have preferably diametrically positioned portions 346 which define slots 348 (as shown in FIG. 8*b*) for receiving the winged portions 338 to allow the winged portions 338 to pass into the recess 341. These interconnecting structures prevent a high energy oncoming game ball impacting at an off center point on the impact surface 316 or 318 from rotating the impact member 316 relative to the striking member 314 thereby causing the impact member 316 to wobble. Hand grips 342 are preferably provided on shaft portions 315 of the striking member 314, although they made also be on shaft portions 325 of the impact member 316. Although described in detail only for embodiment 310, interconnecting structures 236, 238, 240, 241, 246 and 248 of embodiment 210, interconnecting structures 136, 138, 140, 141, 146 and 148 of embodiment 110 and interconnecting structures 36, 38, 40, 41, 46 and 48 of embodiment 10 are essentially identical in structure and function to interconnecting structures 336, 338, 340, 341, 346 and 348 of embodiment 310 so their description will not be repeated for the sake of brevity. The embodiments 10, 110, 210, 310 and 410 are preferably composed of plastic. However, they may also be composed of wood, laminated wood or metal or any combination thereof.

The outer impact members 16, 116, 216 and 316 are preferably interchangeable with each other in order to allow them to be used with the same striking member 14, 114, 214 or 314. Thus, there may be a multiplicity of impact members used with the striking member allowing the user to select the impact member desired for use according to the particular dimensional size, shape and type of impact surface desired for the particular game to be played.

Accordingly, there has been provided, in accordance with the invention, a game apparatus that fully satisfies the objectives set forth above. It is to be understood that all terms used herein are descriptive rather than limiting.

Although the invention has been described in conjunction with the specific embodiments set forth above, many alternative embodiments, modifications and variations will be apparent to those skilled in the art in light of the disclosure set forth herein. Accordingly, it is intended to include all such alternatives, embodiments, modifications and variations that fall within the spirit and scope of the invention as set forth in the claims hereinbelow.

I claim:

1. A game apparatus, comprising:

a striking member for striking a ball;

a pair of outer impact members secured to said striking member at end portions thereof;

a center impact member secured to said striking member at an approximately medial portion thereof;

means for preventing rotation of said pair of impact members relative to said striking member during use, said means for preventing including interconnecting structures located at adjoining portions of one of said pair of outer impact members and said striking member for providing rotationally secure connection of said pair of outer impact members to said striking member.

2. The game apparatus of claim 1 wherein said interconnecting structures include:

a first interconnecting structure securely connected to said one of said pair of impact members, said first interconnecting structure including a first flat portion;

a second interconnecting structure securely connected to said striking member, said second interconnecting structure including a second flat portion, said first and second interconnecting structures snugly fitting together so that said first flat portion mates with said second flat portion in order to generally prevent rotational movement of said one of said pair of impact members and said striking member relative to each other.

3. The game apparatus of claim 2 wherein;

said first interconnecting structure is a male structure;

said second interconnecting structure is a female structure for receiving said first interconnecting structure.

4. The game apparatus of claim 1 wherein said outer impact members are spaced from said center impact member a distance selected to accomodate dimensional size of a game playing area in order to enhance deft use of the game apparatus in the game playing area.

5. The game apparatus of claim 1 wherein said pair of outer impact members, said center impact member and said striking member are dimensioned to accommodate dimensional size of a game playing area in order to enhance deft use of the game apparatus in the game playing area.

6. The game apparatus of claim 1, wherein at least one of said pair of impact members has an impact surface which is generally flat.

7. The game apparatus of claim 1, wherein at least one of said pair of impact members has an impact surface which is disposed at an angle selected to direct the ball generally in a direction which is at a desired angle relative to the plane of the user.

8. A game apparatus, comprising:

a striking member for striking a ball, said striking member having dual hand grips;

a pair of outer impact members positioned at opposite ends of said striking member;

a center impact member secured to said striking member at a medial portion thereof;

means for detachably securing said pair of outer impact members to said striking member at its opposite ends, said means for detachably securing positioned adjacent said hand grips, so that the game apparatus may be used with either two or three impact members while utilizing said hand grips.

9. The game apparatus of claim 8, wherein said pair of outer impact members includes a multiplicity of pairs of outer impact members, said multiplicity of pairs of outer impact members being interchangeable with each other when secured to said striking member, said multiplicity of pairs having various dimensional sizes, each of said multiplicity of pairs having a dimensional size selected to accomodate one of a multiplicity of game playing areas to allow the game apparatus to accomodate game playing areas of various selected dimensional sizes.

10. The game apparatus of claim 8 wherein said means for detachably securing includes:

a first attaching structure, said first attaching structure secured to one of said outer impact members; and a second attaching structure secured to said striking member, said first attaching structure mating with said second attaching structure.

11. The game apparatus of claim 10, wherein:

said first attaching structure is a threaded female structure; and said second attaching structure is a male threaded structure for receiving said first attaching structure.

12. The game apparatus of claim 8, wherein said pair of outer impact members are spaced from said center impact member a distance selected to accomodate the dimensional size of a desired playing area in order to enhance deft use of the game apparatus in the playing area and wherein said center impact member is dimensionally smaller than said pair of outer impact members to facilitate spacing of said pair of outer impact members from said center impact member the distance selected to accomodate the dimensional size of the desired playing area.

13. The game apparatus of claim 8, wherein said pair of outer impact members, said center impact member and said striking member are dimensioned to accomodate the dimensional size of a desired game playing area in order to enhance deft use of the game apparatus in the playing area and wherein said center impact member is dimensionally smaller than said pair of outer impact members to facilitate dimensioning of said pair of outer impact members, said center impact member and said striking member to accomodate the dimensional size of the desired game playing area.

14. The game apparatus of claim 8, wherein at least one of said pair of outer impact members has an impact surface which is generally flat.

15. The game apparatus of claim 8, wherein at least one of said pair of outer impact members has an impact surface which is disposed at an angle selected to propel the ball in a desired angular direction relative to the user.

16. A game apparatus, comprising:

a striking member for striking a ball;

a pair of hand grips mounted at opposite end portions of said striking member;

a pair of outer impact members secured to said striking member at opposite ends thereof, each of said pair having a first impact surface and a second impact surface, said first impact surface being generally inwardly stepped and said second impact surface being generally flat;

a center impact member secured to said striking member at a medial portion thereof.

17. A game apparatus, comprising:

a striking member for striking a ball, said striking member having dual hand grips;

a pair of outer impact members secured to said striking member at end portions thereof;

a center impact member secured to said striking member at an approximately medial portion thereof;

a male interconnecting structure securely connected to one of said pair of impact members, said male structure having winged portions;

a female interconnecting structure securely connected to said striking member, said female structure having portions defining a recess for receiving said winged portions, said male and said female interconnecting structures snugly fitting together in order to generally prevent rotational movement relative to each other during use.

18. A game apparatus, comprising:

a striking member for striking a ball, said striking member having dual hand grips;

a pair of outer impact members secured to said striking member at an approximately medial portion thereof, at least one of said pair of impact members having an impact surface which is stepped in order to provide desired game playing characteristics to said at least one of said pair of impact members;

a center impact member secured to said striking member at an approximately medial portion thereof;

means for preventing rotation of said pair of impact members relative to said striking member during use.

19. A game apparatus, comprising:

a striking member for striking a ball, said striking member having dual grips;

a pair of outer impact members secured to said striking member at an approximately medial portion thereof, at least one of said pair of impact members having an impact surface which is generally concave having a radius of curvature selected to accomodate the size of the ball;

a center impact member secured to said striking member at an approximately medial portion thereof;

means for preventing rotation of said pair of impact members relative to said striking member during use.

20. A game apparatus, comprising:

a striking member for striking a ball, said striking member having dual hand grips;

a pair of outer impact members positioned at opposite ends of said striking member, at least one of said pair of impact members having an impact surface which is stepped inwardly in order to provide desired game playing characteristics to said at least one of said pair of impact members;

a center impact member secured to said striking member at a medial portion thereof;

means for detachably securing said pair of outer impact members to said striking member at its opposite ends.

21. A game apparatus, comprising:

a striking member for striking a ball, said striking member having dual hand grips;

a pair of outer impact members positioned at opposite ends of said striking member, at least one of said pair of impact members having an impact surface which is generally concave having a radius of curvature selected to accomodate the size of the ball;

a center impact member secured to said striking member at a medial portion thereof;

means for detachably securing said pair of outer impact members to said striking member at its opposite ends.

22. A game apparatus, comprising:

a striking member for striking a ball;

a pair of outer impact members positioned at opposite ends of said striking member, at least one of said pair of impact members having an impact surface which is stepped inwardly in order to provide desired game playing characteristics to said at least one of said pair of outer impact members;

a center impact member secured to said striking member at a medial portion thereof.

23. A game apparatus, comprising:

a striking member for striking a ball;

a pair of outer impact members positioned at opposite ends of said striking member, at least one of said pair of impact members having an impact surface which is generally concave having a radius of curvature selected to accomodate the size of the ball;

a center impact member secured to said striking member at a medial portion thereof.

24. The game apparatus of claim 1 wherein at least one of said interconnecting structures includes a slotted portion to provide rotationally secure connection of at least one of said pair of outer impact members to said striking member.

* * * * *